US010707579B2

(12) United States Patent
Krogerus

(10) Patent No.: US 10,707,579 B2
(45) Date of Patent: Jul. 7, 2020

(54) APPARATUS AND METHODS FOR WIRELESS COMMUNICATION

(71) Applicant: Nokia Technologies Oy, Espoo (FI)

(72) Inventor: Joonas Krogerus, Espoo (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 82 days.

(21) Appl. No.: 15/325,123

(22) PCT Filed: Jul. 2, 2015

(86) PCT No.: PCT/FI2015/050481
§ 371 (c)(1),
(2) Date: Jan. 10, 2017

(87) PCT Pub. No.: WO2016/005659
PCT Pub. Date: Jan. 14, 2016

(65) Prior Publication Data

US 2017/0162941 A1 Jun. 8, 2017

(30) Foreign Application Priority Data

Jul. 10, 2014 (GB) ..... 1412252.7

(51) Int. Cl.
*H01Q 1/24* (2006.01)
*H01Q 5/30* (2015.01)
(Continued)

(52) U.S. Cl.
CPC ..... *H01Q 5/364* (2015.01); *H01Q 5/307* (2015.01); *H01Q 5/35* (2015.01); *H01Q 5/40* (2015.01);
(Continued)

(58) Field of Classification Search
CPC ..... H01Q 1/24; H01Q 1/241; H01Q 1/242; H01Q 1/243; H01Q 1/245; H01Q 7/00;
(Continued)

(56) References Cited

U.S. PATENT DOCUMENTS 6,028,559 A 2/2000 Satah et al.
7,358,906 B2 4/2008 Sato et al.
(Continued)

FOREIGN PATENT DOCUMENTS

CN 103367864 A 10/2013
CN 104466396 A 3/2015
(Continued)

OTHER PUBLICATIONS

International Search Report and Written Opinion received for corresponding Patent Cooperation Treaty Application No. PCT/FI2015/050481, dated Sep. 28, 2015, 9 pages.
(Continued)

*Primary Examiner* — Daniel Munoz
*Assistant Examiner* — Patrick R Holecek
(74) *Attorney, Agent, or Firm* — Alston & Bird LLP

(57) ABSTRACT

An apparatus comprising: a first conductive antenna track, extending between a first end and a second end and defining a loop shape, the first conductive antenna track comprising a first feed point adjacent to the first end and configured to couple to radio frequency circuitry; and a second conductive antenna track coupled to the first conductive antenna track at a first location in proximity to the first feed point, and at a second location between the first end and the second end of the first conductive antenna track, to form a first closed loop configured to resonate in a first operational frequency band.

17 Claims, 6 Drawing Sheets

(51) Int. Cl.

| | |
|---|---|
| ***H01Q 7/00*** | (2006.01) |
| ***H01Q 5/364*** | (2015.01) |
| ***H01Q 5/40*** | (2015.01) |
| ***H01Q 5/35*** | (2015.01) |
| ***H01Q 5/307*** | (2015.01) |
| ***H01Q 21/28*** | (2006.01) |
| *H01Q 5/321* | (2015.01) |

(52) U.S. Cl.
CPC ..... *H01Q 7/00* (2013.01); *H01Q 21/28* (2013.01); *H01Q 1/243* (2013.01); *H01Q 5/321* (2015.01)

(58) Field of Classification Search
CPC ..... H01Q 5/30; H01Q 5/307; H01Q 5/314; H01Q 5/321; H01Q 5/35; H01Q 5/364; H01Q 5/371; H01Q 5/40; H01Q 21/28
See application file for complete search history.

(56) References Cited

U.S. PATENT DOCUMENTS

| | | | | |
|---|---|---|---|---|
| 7,728,785 | B2 | 6/2010 | Ozden | |
| 7,729,721 | B2 * | 6/2010 | Kim | H01Q 1/243 455/350 |
| 7,812,774 | B2 | 10/2010 | Friman et al. | |
| 7,876,279 | B2 | 1/2011 | Ma | |
| 7,903,039 | B2 | 3/2011 | Wei | |
| 7,911,404 | B2 | 3/2011 | Yamagajo et al. | |
| 8,648,756 | B1 * | 2/2014 | Desclos | H01Q 5/335 343/702 |
| 8,836,587 | B2 | 9/2014 | Darnell et al. | |
| 9,431,693 | B2 * | 8/2016 | Kwak | H01Q 1/243 |
| 9,711,841 | B2 * | 7/2017 | Yong | H01Q 1/243 |
| 2003/0071757 | A1 | 4/2003 | Yamaki | |
| 2011/0063180 | A1 | 3/2011 | Su | |

FOREIGN PATENT DOCUMENTS

| | | | |
|---|---|---|---|
| GB | 2071424 | A | 9/1981 |
| WO | WO 2011/148225 | A1 | 12/2011 |

OTHER PUBLICATIONS

Office Action for Chinese Application No. 2015800452834 dated Nov. 5, 2018, 7 pages.
Office Action corresponding to Chinese Application No. 201580045283.4, dated Jul. 10, 2019, 15 pages.
Search Report corresponding to Chinese Application No. 201580045283.4, dated Jun. 28, 2019, 4 pages.
Office Action for European Application No. 17 741 580.3 dated Sep. 27, 2018, 4 pages.
Intention to Grant for European Application No. 15 741 580.3 dated Sep. 12, 2019, 5 pages.
Diallo, A. et al., *Reduction of the Mutual Coupling Between Two Planar Inverted-F Antennas Working in Close Frequency Bands*, Automatika 47 (2006) 113-120.
Han, M-S. et al., *MIMO Antenna Using a Decoupling Network for Next Generation Mobile Application*, ISCIT (2009) 568-571.

* cited by examiner

APPARATUS AND METHODS FOR WIRELESS COMMUNICATION

RELATED APPLICATION

This application was originally filed as Patent Cooperation Treaty Application No. PCT/FI2015/050481 filed Jul. 2, 2015 which claims priority benefit to GB application 1412252.7 filed Jul. 10, 2014.

TECHNOLOGICAL FIELD

Embodiments of the present invention relate to apparatus and methods for wireless communication. In particular, they relate to apparatus for wireless communication in an electronic communication device.

BACKGROUND

Apparatus, such as portable electronic communication devices, usually include an antenna arrangement to enable wireless communication with other apparatus. Recently, the number of communication protocols for such apparatus has increased (for example, communication protocols include Bluetooth, Long Term Evolution (LTE), Global system for mobile communications (GSM) and so on) and the apparatus may require several antennas to efficiently operate using those communication protocols. This may increase the size and cost of the apparatus.

It would therefore be desirable to provide an alternative apparatus.

BRIEF SUMMARY

According to various, but not necessarily all, embodiments of the invention there is provided an apparatus comprising: a first conductive antenna track, extending between a first end and a second end and defining a loop shape, the first conductive antenna track comprising a first feed point adjacent to the first end and configured to couple to radio frequency circuitry; and a second conductive antenna track coupled to the first conductive antenna track at a first location in proximity to the first feed point, and at a second location between the first end and the second end of the first conductive antenna track, to form a first closed loop configured to resonate in a first operational frequency band.

The first location at which the second conductive antenna track is coupled to the first conductive antenna track may be within a distance of $\lambda/16$ at the first operational frequency band from the first feed point.

The second conductive antenna track may be coupled to the first conductive antenna track at the first feed point.

The first end and the second end may define an aperture there between, and at least the first conductive antenna track and the second conductive antenna track may define an open loop.

The first conductive antenna track may further comprise a second feed point adjacent to the second end and configured to couple to radio frequency circuitry; and the apparatus may further comprise a third conductive antenna track coupled to the first conductive antenna track at a third location in proximity to the second feed point, and at a fourth location between the first end and the second end of the first conductive antenna track, to form a second closed loop configured to resonate in a second operational frequency band.

The third location at which the third conductive antenna track is coupled to the first conductive antenna track may be within a distance of $\lambda/16$ at the second operational frequency band from the second feed point.

The third conductive antenna track may be coupled to the first conductive antenna track at the second feed point.

The first operational frequency band and the second operational frequency band may at least partially overlap and enable the apparatus to provide a Multiple Input Multiple Output (MIMO) antenna arrangement or a diversity antenna arrangement.

The first operational frequency band and the second operational frequency band may be different to one another.

The first conductive antenna track may further comprise a third feed point configured to couple to radio frequency circuitry to enable operation at a third operational frequency band, the third feed point may be located adjacent to the first end or to the second end, the first conductive antenna track being configured to resonate in the third operational frequency band.

The second conductive antenna track may comprise a radio frequency filter.

The apparatus may further comprise an electronic component positioned within the loop shape of the first conductive antenna track.

At least the first conductive antenna track may form at least a part of a metallic cover of the apparatus.

The first conductive antenna track may further comprise a plurality of feed points configured to couple to radio frequency circuitry; and the apparatus may further comprise a plurality of conductive antenna tracks coupled to the first conductive antenna track at locations in proximity to respective feed points of the plurality of feed point, and at locations between the first end and the second end of the first conductive antenna track, to form a plurality of closed loops configured to resonate in operational frequency bands.

According to various, but not necessarily all, embodiments of the invention there is provided an electronic communication device comprising an apparatus as described in any of the preceding paragraphs.

According to various, but not necessarily all, embodiments of the invention there is provided a module comprising an apparatus as described in any of the preceding paragraphs.

According to various, but not necessarily all, embodiments of the invention there is provided a method comprising: providing a first conductive antenna track, extending between a first end and a second end and defining a loop shape, and comprising a first feed point located adjacent to the first end and configured to couple to radio frequency circuitry; and providing a second conductive antenna track coupled to the first conductive antenna track at a first location in proximity to the first feed point, and at a second location between the first end and the second end of the first conductive antenna track, to form a first closed loop configured to resonate in a first operational frequency band.

The first conductive antenna track may further comprise a second feed point located adjacent to the second end and configured to couple to radio frequency circuitry; and the method may further comprise: providing a third conductive antenna track coupled to the first conductive antenna track at a third location in proximity to the second feed point, and at a fourth location between the first end and the second end of the first conductive antenna track, to form a second closed loop configured to resonate in a second operational frequency band.

The first conductive antenna track may further comprise a third feed point configured to couple to radio frequency circuitry to enable operation at a third operational frequency band, the third feed point may be located adjacent to the first end or the second end, the first conductive antenna track may be configured to resonate in the third operational frequency band.

The method may further comprise positioning an electronic component within the loop shape of the first conductive antenna track.

The first conductive antenna track may further comprise a plurality of feed points configured to couple to radio frequency circuitry; and the method may further comprise: providing a plurality of conductive antenna tracks coupled to the first conductive antenna track at locations in proximity to respective feed points of the plurality of feed points, and at locations between the first end and the second end of the first conductive antenna track, to form a plurality of closed loops configured to resonate in operational frequency bands.

BRIEF DESCRIPTION

For a better understanding of various examples that are useful for understanding the brief description, reference will now be made by way of example only to the accompanying drawings in which.

DETAILED DESCRIPTION

Figure 1:
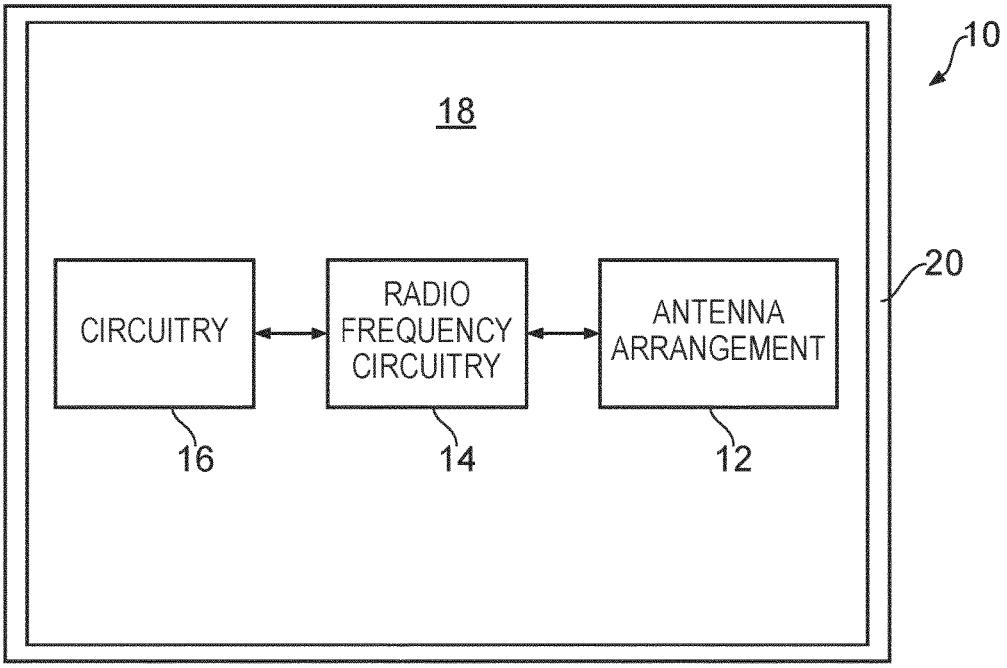
FIG. 1 illustrates a schematic diagram of an apparatus according to various examples.

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

The figures illustrate an apparatus 10 comprising: a first conductive antenna track 22, extending between a first end 26 and a second end 28 and defining a loop shape, the first conductive antenna track 22 comprising a first feed point 30 adjacent to the first end 26 and configured to couple to radio frequency circuitry 14; and a second conductive antenna track 24 coupled to the first conductive antenna track 22 at a first location 32 in proximity to the first feed point 30, and at a second location 34 between the first end 26 and the second end 28 of the first conductive antenna track 22, to form a first closed loop 36 configured to resonate in a first operational frequency band. The apparatus may be for wireless communication.

In more detail, FIG. 1 illustrates an electronic communication device 10 which may be any apparatus such as a hand portable electronic communication device (for example, a mobile cellular telephone, a tablet computer, a laptop computer, a personal digital assistant or a hand held computer), a non-portable electronic communication device (for example, a personal computer or a base station for a cellular network), a portable multimedia device (for example, a music player, a video player, a game console and so on) or a module for such devices. As used here, the term 'module' refers to a unit or apparatus that excludes certain parts or components that would be added by an end manufacturer or a user.

The electronic communication device 10 comprises an antenna arrangement 12, radio frequency circuitry 14, circuitry 16, a ground member 18, and a cover 20. Where the electronic communication device 10 is a module, the electronic communication device 10 may only include the antenna arrangement 12 for example.

The antenna arrangement 12 includes at least one radiator, but may in other examples include a plurality of radiators that are configured to transmit and receive, transmit only or receive only electromagnetic signals. The radio frequency circuitry 14 is connected between the antenna arrangement 12 and the circuitry 16 and may include at least one receiver and/or at least one transmitter and/or at least one transceiver. The circuitry 16 is operable to provide signals to, and/or receive signals from the radio frequency circuitry 14. The electronic communication device 10 may optionally include one or more matching circuits, filters, switches, or other radio frequency circuit elements, and combinations thereof, between the antenna arrangement 12 and the radio frequency circuitry 14.

The radio frequency circuitry 14 and the antenna arrangement 12 may be configured to operate in one or more operational frequency bands. For example, the operational frequency bands may include (but are not limited to) Long Term Evolution (LTE) (B17 (DL:734-746 MHz; UL:704-716 MHz), B5 (DL:869-894 MHz; UL: 824-849 MHz), B20 (DL: 791-821 MHz; UL: 832-862 MHz), B8 (925-960 MHz; UL: 880-915 MHz), B13 (DL: 746-756 MHz; UL: 777-787 MHz), B28 (DL: 758-803 MHz; UL: 703-748 MHz), B7 (DL: 2620-2690 MHz; UL: 2500-2570 MHz), B38 (2570-2620 MHz), B40 (2300-2400 MHz) and B41 (2496-2690 MHz)), amplitude modulation (AM) radio (0.535-1.705 MHz); frequency modulation (FM) radio (76-108 MHz); Bluetooth (2400-2483.5 MHz, 5 GHz); wireless local area network (WLAN) (2400-2483.5 MHz); hiper local area network (HiperLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-

1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz), inductive power standard (Qi) frequencies.

A frequency band over which an antenna can efficiently operate is a frequency range where the antenna's return loss is less than an operational threshold. For example, efficient operation may occur when the antenna's return loss is better than (that is, less than) −4 dB or −6 dB.

The antenna arrangement 12 may provide a part of a diversity arrangement (for example, a first antenna of two or more), a diversity antenna arrangement on its own, a part of a multiple input multiple output (MIMO) arrangement (for example, a first antenna of two or more), or a multiple input multiple output (MIMO) arrangement on its own.

The circuitry 16 may include processing circuitry, memory circuitry and input/output devices such as an audio input device (a microphone for example), an audio output device (a loudspeaker for example), a display, a camera, charging circuitry, and a user input device (such as a touch screen display and/or one or more buttons or keys).

The antenna arrangement 12 and the electronic components that provide the radio frequency circuitry 14 and the circuitry 16 may be interconnected via the ground member 18 (for example, a printed wiring board). The ground member 18 may be used as a ground plane for the antenna arrangement 12 by using one or more layers of the printed wiring board. In other embodiments, some other conductive part of the electronic communication device 10 (a battery cover or a chassis (such as a display chassis) within the interior of the cover 20 for example) may be used as the ground member 18 for the antenna arrangement 12. In some examples, the ground member 18 may be formed from several conductive parts of the electronic communication device 10, one part of which may include the printed wiring board. The ground member 18 may be planar or non-planar.

The cover 20 has an exterior surface that defines one or more exterior visible surfaces of the electronic communication device 10 and also has an interior surface that defines a cavity configured to house the electronic components of the electronic communication device 10 such as the radio frequency circuitry 14, the circuitry 16 and the ground member 18. The cover 20 may comprise a plurality of separate cover portions that may be coupled to one another to form the cover 20. For example, the cover 20 may include a front cover portion that is provided by a display module, and a back cover portion that couples to the display module.

Figure 2:
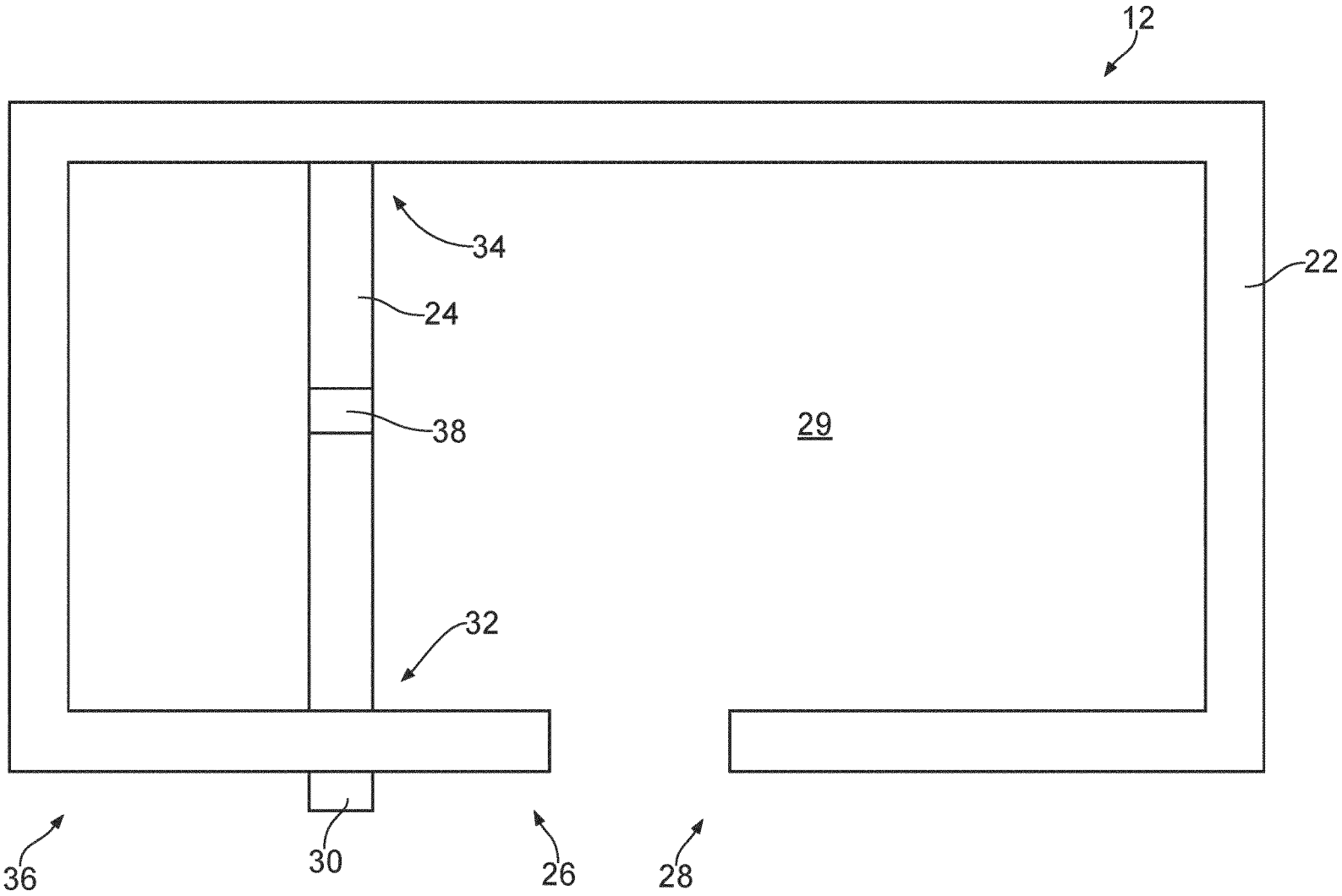
FIG. 2 illustrates a plan view of an antenna arrangement according to various examples.

FIG. 2 illustrates a plan view of an antenna arrangement 12 according to various examples. The antenna arrangement 12 includes a first conductive antenna track 22 and a second conductive antenna track 24. In this example, the antenna arrangement 12 is planar. In other examples, the antenna arrangement 12 may be non-planar and the first conductive antenna track 22 and/or the second conductive antenna track may extend in three dimensions.

The first conductive antenna track 22 includes a first end 26 and a second end 28 and extends between the first end 26 and the second end 28 to define a loop shape. There may be no intervening galvanic connections between the first and second ends other 26, 28 other than those provided between the first and second conductive antenna tracks 22, 24. In other words, the first conductive antenna track 22 defines an 'open loop', meaning that the loop has a conductive track (that is, the first conductive antenna track 22) which starts at the first end 26 (or a first terminal) and extends towards the second end 28 (or a second terminal) forming a non-conductive area within the conductive track, the non-conductive area 29 having an open end located between the first and second ends 26, 28 (in other words, an aperture is defined between the first and second ends 26, 28), and a closed end opposite the open end.

In FIG. 2, the first conductive antenna track 22 forms a rectangular loop shape. In other examples, the first conductive antenna track 22 may form a loop having a different shape such as (but not limited to) a circular loop, an elliptical loop, a square loop, an irregular shaped loop and so on.

The first conductive antenna track 22 includes a first feed point 30 positioned adjacent to the first end 26. In some examples, the first feed point 30 may be located at the first end 26 (that is, the distance between the first feed point 30 and the first end 26 is zero). In other examples, the first feed point 30 may be located in proximity to the first end 26.

The first feed point 30 is configured to couple to the radio frequency circuitry 14 illustrated in FIG. 1. For example, the first feed point 30 may include a connector that is arranged to galvanically connect to a first port of the radio frequency circuitry 14.

The second conductive antenna track 24 is coupled to the first conductive antenna track 22 at a first location 32 in proximity to the first feed point 30. The second conductive antenna track 24 is also coupled to the first conductive antenna track 22 at a second location 34 between the first end 26 and the second end 28 of the first conductive antenna track 22.

The coupling of the second conductive antenna track 24 to the first conductive antenna track 22 at the location 32 and/or 34 may be via a galvanic connection. For example, the second conductive antenna track 24 may be integral with the first conductive antenna track 22 (in other words, the first and second conductive antenna tracks 22, 24 may be formed from the same piece of conductive material and there may be no interface between them). By way of another example, the second conductive antenna track 24 may be formed separately to the first conductive antenna track 22 and then galvanically connected to the first conductive antenna track 22 (via soldering for example).

The coupling of the second conductive antenna track 24 to the first conductive antenna track 22 at the location 32 and/or 34 may alternatively be via electromagnetic coupling. For example, the first conductive antenna track 22 and the second conductive antenna track 24 may not be physically connected to one another and may instead be capacitively coupled to one another.

The first conductive antenna track 22 and the second conductive antenna track 24 form a first closed loop 36 that is configured to resonate in a first operational frequency band. In other words, the first closed loop 36 has an electrical length that is selected to enable resonance in the first operational frequency band.

As used herein, the 'electrical length' is the length of a current path expressed in terms of the wavelength. The electrical length may be related to a physical length and/or width of a radiator. The electrical length need not be equal to any of the physical dimensions, as for example meandering or adding discrete components may change the electrical length. In addition, adding a slot in a radiator makes the electrical length longer as the current path is a combination of transverse and longitudinal components.

In operation, the radio frequency circuitry 14 may provide a signal to the antenna arrangement 12 via the first feed point 30 that causes the first closed loop 36 to resonate at the first operational frequency band (where the current density is greatest in the first closed loop 36). The antenna arrangement 12 consequently radiates an electromagnetic signal in the first operational frequency band.

Additionally or alternatively, the antenna arrangement 12 may receive an electromagnetic signal in the first operational frequency band that causes the first closed loop 36 to resonate (where the current density is greatest in the first closed loop 36). The antenna arrangement 12 provides the signal to the radio frequency circuitry 14 via the first feed point 30.

In some examples, the location 32 at which the second conductive antenna track 24 is coupled to the first conductive antenna track 22 is within a distance of $\lambda/16$ at the first operational frequency band from the first feed point 30 (where $\lambda$ is the central wavelength of the first operational frequency band). In other examples, the second conductive antenna track 24 is coupled to the first conductive antenna track 22 at the first feed point 30 (in other words, there is substantially zero distance between the first feed point 30 and the location 32).

In some examples, the second conductive antenna track 24 may include a radio frequency filter 38 that is configured to filter radio frequency signals in the second conductive antenna track 24 having predetermined frequencies. The radio frequency filter 38 may include any suitable reactive components and may include, for example, lumped components such as one or more capacitors and/or one or more inductors.

In some examples, at least the first conductive antenna track 22 forms at least a part of the cover 20 of the apparatus 10. For example, the first conductive antenna track 22 may provide a metallic cover for the lower transverse edge of a portable electronic communication device (such as a mobile cellular telephone). The second conductive antenna track 24 may also form a part of the cover 20 of the apparatus 10.

Figure 3:
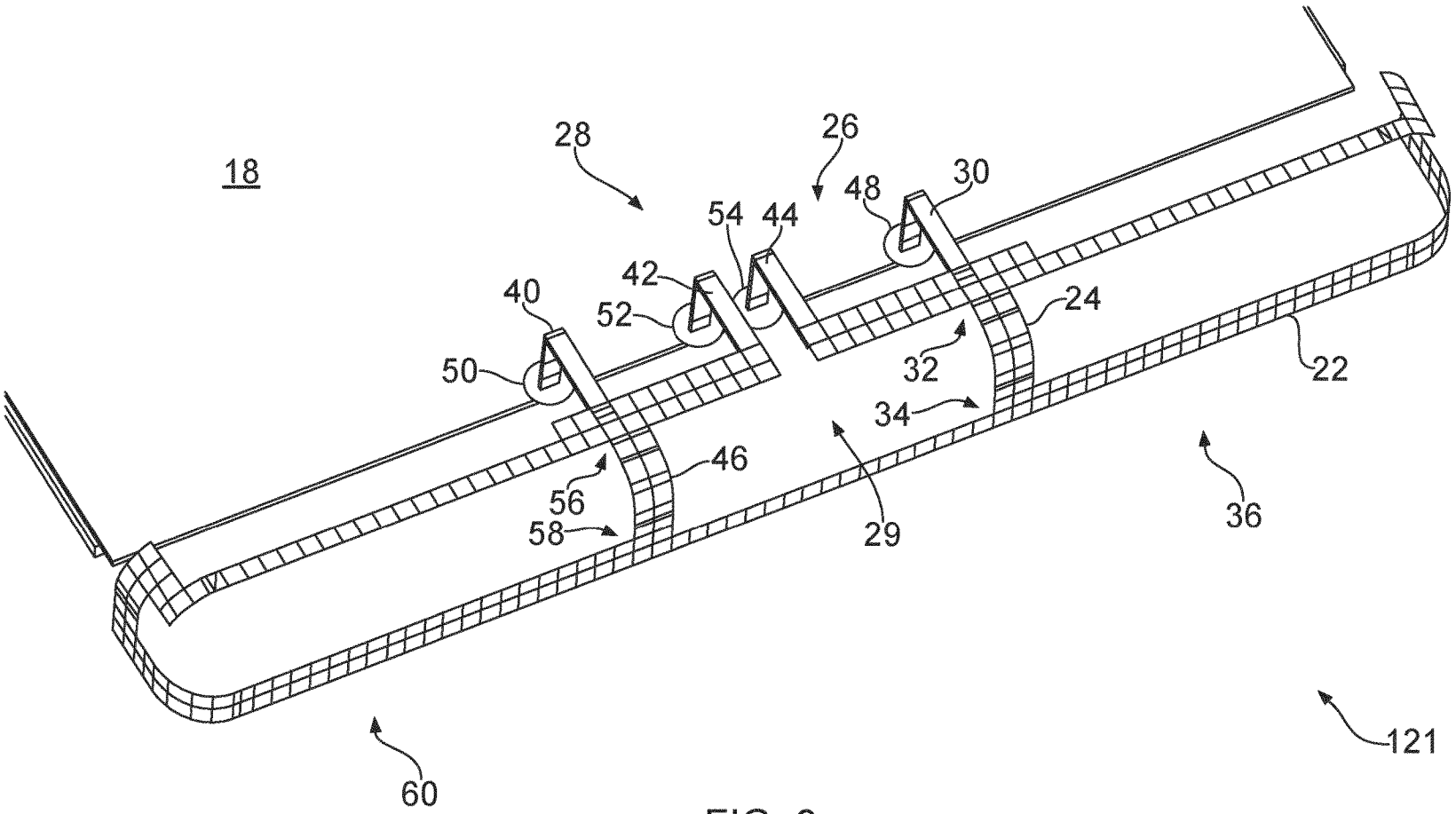
FIG. 3 illustrates a perspective view of another antenna arrangement according to various examples.

FIG. 3 illustrates a perspective view of another antenna arrangement 121 according to various examples. The antenna arrangement 121 is similar to the antenna arrangement 12, and where the features are similar or the same, the same reference numerals are used.

The antenna arrangement 121 differs from the antenna arrangement 12 in that the antenna arrangement 121 further comprises a second feed point 40, a third feed point 42, a ground point 44, and a third conductive antenna track 46. The antenna arrangement 121 also differs from the antenna arrangement 12 in that the antenna arrangement 121 is non-planar and extends in three dimensions. In this example, the first conductive antenna track 22, the second conductive antenna track 24 and the third conductive antenna track 46 include curved portions that are shaped to fit within, or to provide, the transverse lower edge of the cover 20 of the apparatus 10.

The first conductive antenna track 22 defines an open loop. A T-shaped non-conductive area 29 is defined between the first conductive antenna track 22, the second conductive antenna track 24 and the third conductive antenna track 46. In other examples, the non-conductive area 29 may have a shape other than a T-shape, and may be any shape which forms a loop which is a regular shape, for example and not limited to a circle, an oval, a rectangle, a triangle, and so on. On the other hand, the area 29 may have an irregular shape which may be polygonal or any other irregular shape.

As in the antenna arrangement 12 illustrated in FIG. 2, the first feed point 30 is positioned in proximity to the first end 26 of the first conductive antenna track 22. The first feed point 30 is configured to couple to the radio frequency circuitry 14 illustrated in FIG. 1. For example, the first feed point 30 may include a connector that is arranged to galvanically connect to a first port 48 of the radio frequency circuitry 14.

The second feed point 40 is positioned adjacent to the second end 28. In this example, the second feed point 40 is located in proximity to the second end 28, but in other examples, the second feed point 40 may be located at the second end 28 (that is, the distance between the second feed point 40 and the second end 28 may be zero).

The second feed point 40 is configured to couple to the radio frequency circuitry 14 illustrated in FIG. 1. For example, the second feed point 40 may include a connector that is arranged to galvanically connect to a second port 50 of the radio frequency circuitry 14.

The third feed point 42 is positioned adjacent to the second end 28. In this example, the third feed point 42 is located at the second end 28 (that is, the distance between the third feed point 42 and the second end 28 is zero). In other examples, the third feed point 42 may be located in proximity to the second end 28.

The third feed point 42 is configured to couple to the radio frequency circuitry 14 illustrated in FIG. 1. For example, the third feed point 42 may include a connector that is arranged to galvanically connect to a third port 52 of the radio frequency circuitry 14.

The ground point 44 is positioned at the first end 26 (that is, the distance between the ground point 44 and the first end 26 is zero). In other examples, the ground point 44 may be located between the first end 26 and the first feed point 30. The ground point 44 is configured to connect to the ground member 18. For example, the ground point 44 may include a connector for connecting to a ground port 54 of the ground member 18.

The third conductive antenna track 46 is coupled to the first conductive antenna track 22 at a third location 56 in proximity to the second feed point 40. The third conductive antenna track 46 is also coupled to the first conductive antenna track 22 at a fourth location 58 between the first end 26 and the second end 28 of the first conductive antenna track 22.

The coupling of the third conductive antenna track 46 to the first conductive antenna track 22 at the location 56 and/or 58 may be via a galvanic connection. For example, the third conductive antenna track 46 may be integral with the first conductive antenna track 22 (in other words, the first and third conductive antenna tracks 22, 46 may be formed from the same piece of conductive material and there may be no interface between them). By way of another example, the third conductive antenna track 46 may be formed separately to the first conductive antenna track 22 and then galvanically connected to the first conductive antenna track 22 (via soldering for example).

The coupling of the third conductive antenna track 46 to the first conductive antenna track 22 at the location 56 and/or 58 may be via electromagnetic coupling. For example, the first conductive antenna track 22 and the third conductive antenna track 46 may not be physically connected to one another and may instead be capacitively coupled to one another.

The first conductive antenna track 22 and the third conductive antenna track 46 form a second closed loop 60 that is configured to resonate in a second operational frequency band. In other words, the second closed loop 60 has an electrical length that is selected to enable resonance in the second operational frequency band.

In operation, the radio frequency circuitry 14 may provide a signal to the antenna arrangement 121 via the second feed point 40 that causes the second closed loop 60 to resonate at the second operational frequency band (where the current density is greatest in the second closed loop 60). The antenna arrangement 121 consequently radiates an electromagnetic signal in the second operational frequency band.

Additionally or alternatively, the antenna arrangement 121 may receive an electromagnetic signal in the second operational frequency band that causes the second closed loop 60 to resonate (where the current density is greatest in the second closed loop 60). The antenna arrangement 121 provides the signal to the radio frequency circuitry 14 via the second feed point 40.

The first operational frequency band and the second operational frequency band may at least partially overlap and may advantageously enable the antenna arrangement 121 to provide a Multiple Input Multiple Output (MIMO) antenna or a diversity antenna. For example, the first and second operational frequency bands may be Long Term Evolution (LTE) frequency bands. In other examples, the first operational frequency band and the second operational frequency band are different to one another and do not overlap one another.

In some examples, the location 56 at which the third conductive antenna track 46 is coupled to the first conductive antenna track 22 is within a distance of $\lambda/16$ at the second operational frequency band from the second feed point 40 (where $\lambda$ is the central wavelength of the second operational frequency band). In other examples, the third conductive antenna track 46 is coupled to the first conductive antenna track 22 at the second feed point 40 (in other words, there is substantially zero distance between the second feed point 40 and the location 56).

The second conductive antenna track 24 and/or the third conductive antenna track 46 may include one or more radio frequency filters as described above with reference to FIG. 2.

The first conductive antenna track 22 forms a loop antenna between the third feed point 42 and the ground point 44 that is configured to resonate in a third operational frequency band. In other words, the electrical length of the first conductive antenna track 22 is selected to enable resonance in the third operational frequency band.

In operation, the radio frequency circuitry 14 may provide a signal to the antenna arrangement 121 via the third feed point 42 that causes the first conductive antenna track 22 to resonate at the third operational frequency band. The antenna arrangement 121 consequently radiates an electromagnetic signal in the third operational frequency band.

Additionally or alternatively, the antenna arrangement 121 may receive an electromagnetic signal in the third operational frequency band that causes the first conductive track 22 to resonate. The antenna arrangement 121 provides the signal to the radio frequency circuitry 14 via the third feed point 42.

The antenna arrangement 121 is advantageous in that the first feed point 30 and the second feed point 40 are isolated from one another due to the second and third conductive antenna tracks 24, 46 and by the physical separation of the first closed loop 36 and the second closed loop 60 and may consequently enable efficient operation in the first and second operational frequency bands respectively.

The antenna arrangement 121 is also advantageous in that in addition to the first and second operational frequency bands, the antenna arrangement 121 is configured to operate in the third operational frequency band. In some examples, the electrical length of the first conductive antenna track 22 is greater than the electrical lengths of the first and second closed loops 36, 60 and consequently, the antenna arrangement 121 is configured to operate efficiently in a 'low' operational frequency band, and two 'high' operational frequency bands (that are higher in frequency than the 'low' operational frequency band). For example, the 'low' operational frequency band may be Long Term Evolution (LTE) (B17 (DL:734-746 MHz; UL:704-716 MHz)), and the two 'high' operational frequency bands may be Long Term Evolution (LTE) (B7 (DL: 2620-2690 MHz; UL: 2500-2570 MHz)).

Figure 4:
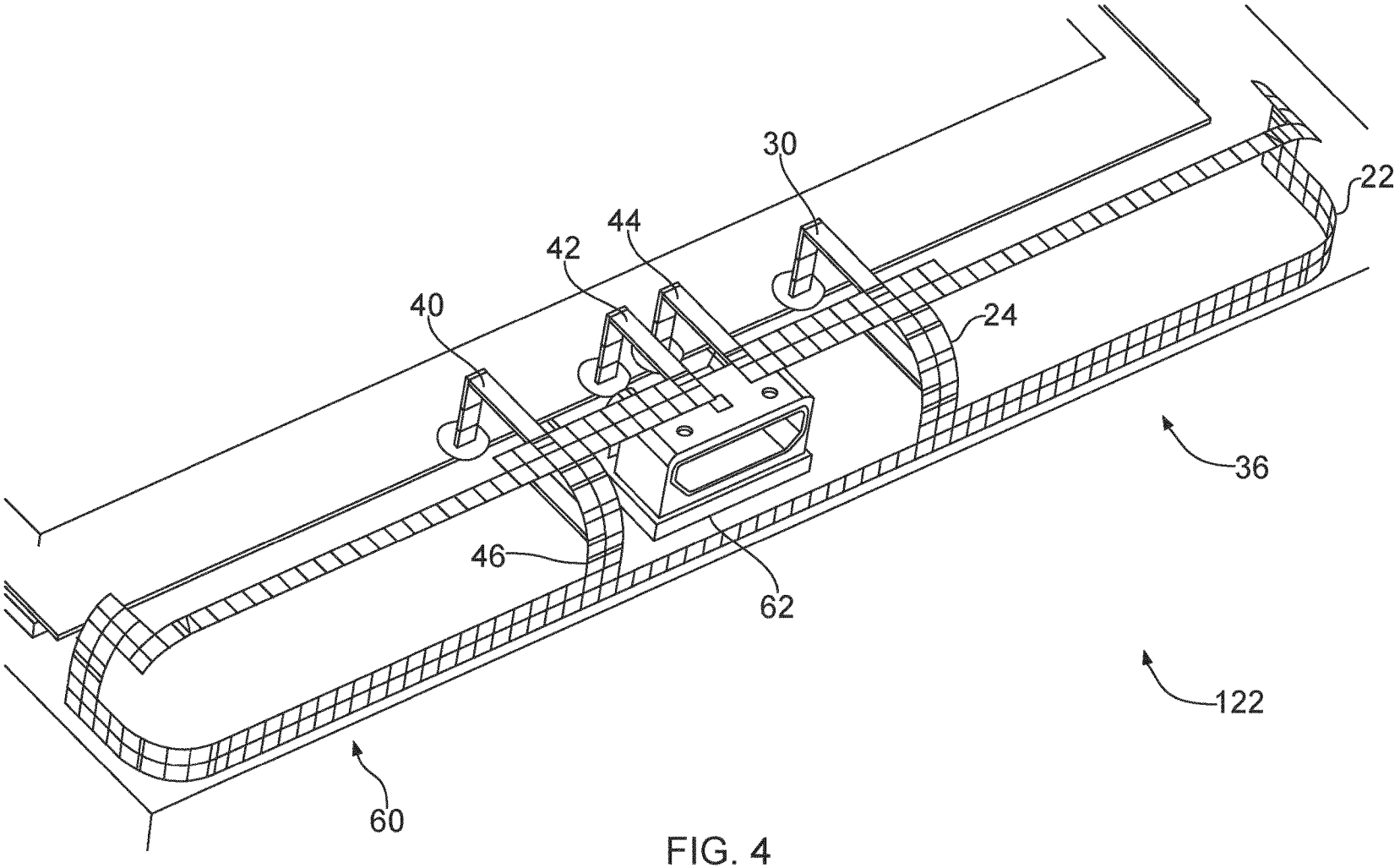
FIG. 4 illustrates a perspective view of a further antenna arrangement according to various examples.

FIG. 4 illustrates a perspective view of a further antenna arrangement 122 according to various examples. The antenna arrangement 122 is similar to the antenna arrangement 121 and where the features are similar or the same, the same reference numerals are used.

The antenna arrangement 122 differs from the antenna arrangement 121 in that the antenna arrangement 122 further comprises an electronic component 62 positioned within the loop shape of the first conductive antenna track 22.

In this example, the electronic component 62 is a Universal Serial Bus (USB) socket that is positioned adjacent to the third feed point 42 and to the ground point 44. A Universal Serial Bus connector (not illustrated in the figure) may be inserted into the USB socket by inserting the USB connector through an aperture defined by the first conductive antenna track 22, the second conductive antenna 24 and the third conductive antenna track 46.

In other examples, the electronic component 62 may be any other electronic component and may be, for example, a camera module, a loudspeaker, a microphone and so on. In some examples, a plurality of electronic components 62 (which may be the same as one another or may be different to one another) may be positioned within the loop shape of the first conductive antenna track 22.

Figure 5:
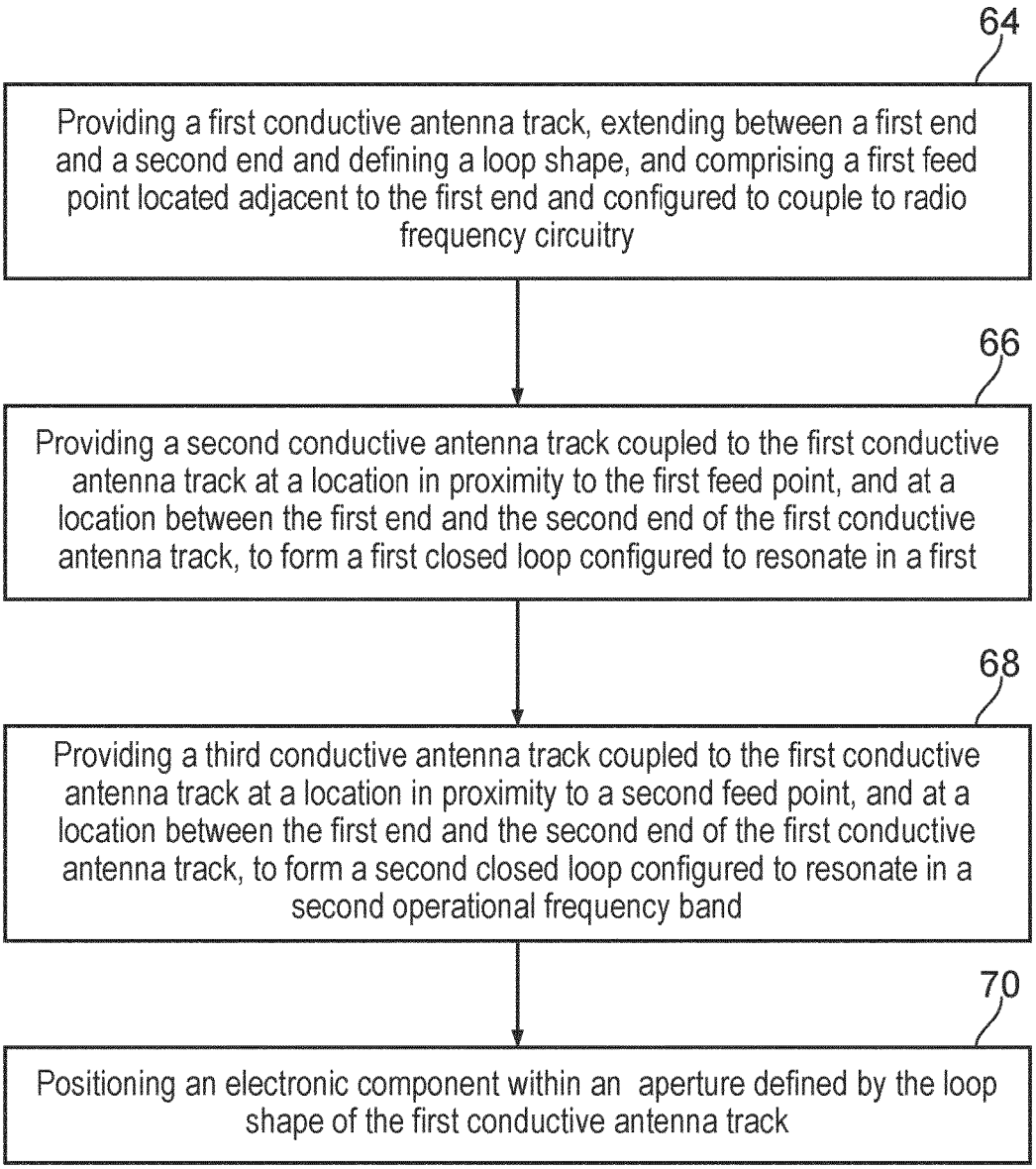
FIG. 5 illustrates a flow diagram of a method of manufacturing an apparatus according to various examples.

FIG. 5 illustrates a flow diagram of a method of manufacturing an apparatus according to various examples.

At block 64, the method includes providing the first conductive antenna track 22, extending between the first end 26 and the second end 28 and defining the loop shape. The first conductive antenna track 22 includes the first feed point 30 located adjacent to the first end 26 and configured to couple to radio frequency circuitry 14. In some examples, the first conductive antenna track 22 may include any number of feed points and any number of ground points.

At block 66, the method includes providing the second conductive antenna track 24. Where the second conductive antenna track 24 is separate to the first conductive antenna track 22, the second conductive antenna track 24 may be coupled to the first conductive antenna track 22 via soldering, for example. Where the second conductive antenna track 24 is integral with the first conductive antenna track 22, block 66 is performed at the same time as block 64.

At block 68, the method includes providing the third conductive antenna track 46. Where the third conductive antenna track 46 is separate to the first conductive antenna track 22, the third conductive antenna track 46 may be coupled to the first conductive antenna track 22 via soldering, for example. Where the third conductive antenna track 46 is integral with the first conductive antenna track 22, block 68 is performed at the same time as block 64. One or more additional conductive antenna tracks may be provided at block 68 to form a plurality of closed loops.

At block 70, the method includes positioning an electronic component 62 within the loop shape of the first conductive antenna track 22.

The blocks illustrated in FIG. 5 may represent steps in a method and/or sections of code in a computer program. For example, a controller may read the computer program to control machinery to perform the blocks illustrated in FIG. 5. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Figure 6:
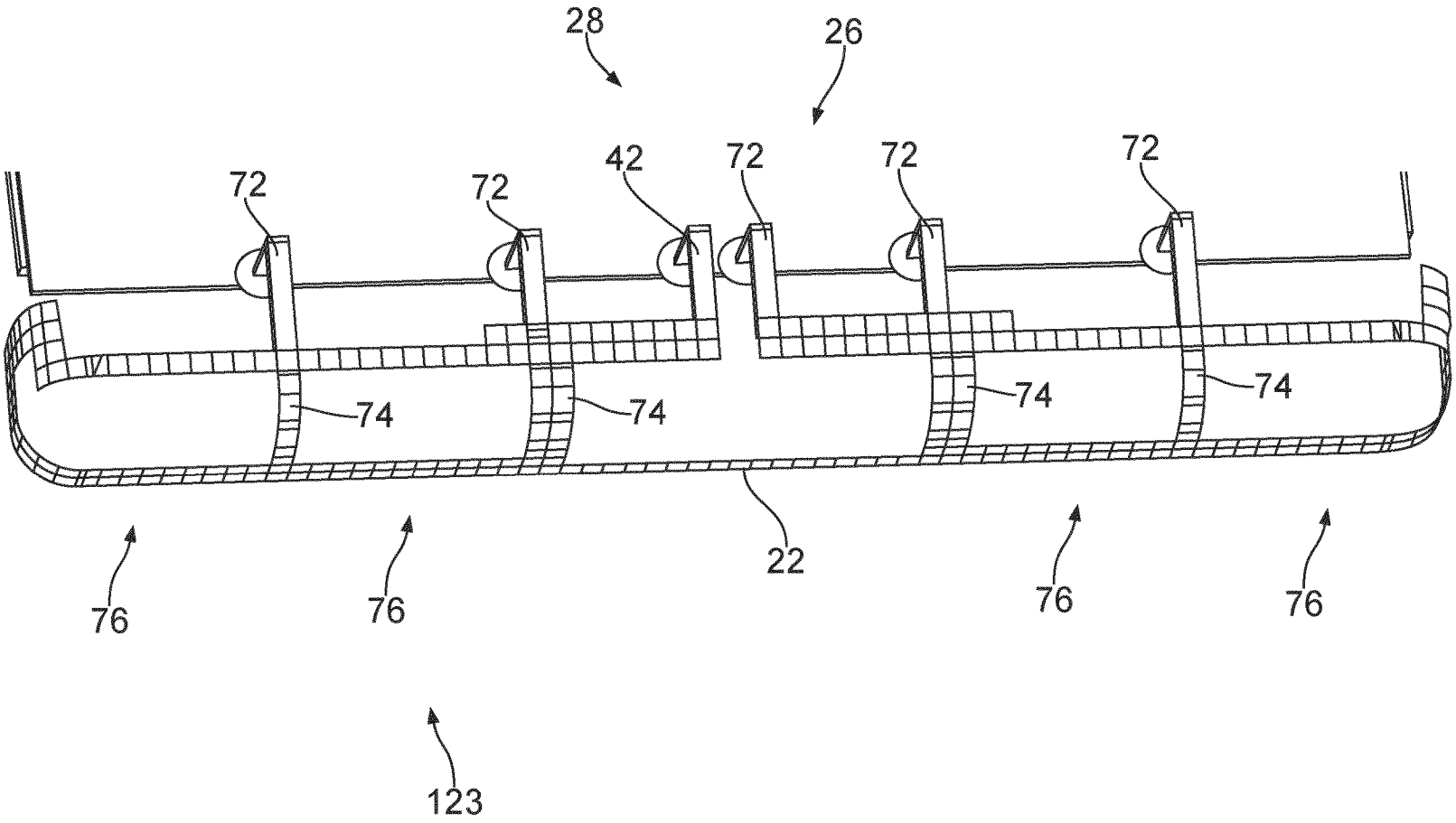
FIG. 6 illustrates a perspective view of another antenna arrangement according to various examples.

For example, the antenna arrangement 12 may comprise any number of feed points and conductive antenna tracks that form closed loops configured to resonate in operational frequency bands. By way of an example, FIG. 6 illustrates a perspective view of another antenna arrangement 123 according to various examples. In this example, the first conductive antenna track 22 further comprises a plurality of feed points 72 configured to couple to the radio frequency circuitry 14 illustrated in FIG. 1.

The apparatus 123 also comprises a plurality of conductive antenna tracks 74 coupled to the first conductive antenna track 22 at locations in proximity to respective feed points of the plurality of feed points 72, and at locations between the first end 26 and the second end 28 of the first conductive antenna track 22. The plurality of conductive antenna tracks 74 form a plurality of closed loops 76 configured to resonate in operational frequency bands. The plurality of closed loops 76 may be the same size as one another. In other examples, the plurality of closed loops 76 may have different loop areas and/or have differing track widths (where thinner conductive antenna tracks are more inductive and wider conductive antenna tracks are more capacitive). The differing loop areas and/or track widths affect the resonant frequencies and bandwidths of the antenna arrangement 12.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a first conductive antenna track, extending between a first end and a second end and defining a loop shape, the first conductive antenna track comprising a first feed point adjacent to the first end and configured to couple to a radio frequency circuitry, wherein the first conductive antenna track further comprises a second feed point adjacent to the second end and configured to couple to the radio frequency circuitry, wherein the first conductive antenna track further comprises a third feed point adjacent to the second end and configured to couple to the radio frequency circuity, wherein the first conductive antenna track further comprises a ground point adjacent to the first end, and wherein the first conductive antenna track is configured to form a loop antenna between the third feed point and the ground point and to resonate in a third operational frequency band;

a second conductive antenna track coupled to the first conductive antenna track at a first location in proximity to the first feed point, and at a second location between the first end and the second end of the first conductive antenna track, to form a first closed loop configured to resonate in a first operational frequency band; and a third conductive antenna track coupled to the first conductive antenna track at a third location in proximity to the second feed point, and at a fourth location between the first end and the second end of the first conductive antenna track, to form a second closed loop configured to resonate in a second operational frequency band, wherein at least one of the first conductive antenna track comprises a curved non-planar portion between the first end and the second end or the second conductive antenna track comprises a curved non-planar portion between the first and second locations or the third conductive antenna track comprises a curved non-planar portion between the third and fourth locations, and wherein the curved non-planar portion of at least one of the first conductive antenna track, the second conductive antenna track or the third conductive antenna track is configured to form at least a part of a metallic cover of the apparatus.

2. An apparatus as claimed in claim 1, wherein the first location at which the second conductive antenna track is coupled to the first conductive antenna track is within a distance of $\lambda/16$ at the first operational frequency band from the first feed point.

3. An apparatus as claimed in claim 1, wherein the second conductive antenna track is coupled to the first conductive antenna track at the first feed point.

4. An apparatus as claimed in claim 1, wherein the first end and the second end define an aperture there between, and at least the first conductive antenna track and the second conductive antenna track define an open loop.

5. An apparatus as claimed in claim 1, wherein the third location at which the third conductive antenna track is coupled to the first conductive antenna track is within a distance of $\lambda/16$ at the second operational frequency band from the second feed point.

6. An apparatus as claimed in claim 5, wherein the third conductive antenna track is coupled to the first conductive antenna track at the second feed point.

7. An apparatus as claimed in claim 1, wherein the first operational frequency band and the second operational frequency band at least partially overlap and enable the apparatus to provide a Multiple Input Multiple Output (MIMO) antenna arrangement or a diversity antenna arrangement.

8. An apparatus as claimed in claim 1, wherein the first operational frequency band and the second operational frequency band are different to one another.

9. An apparatus as claimed in claim 1, wherein the second conductive antenna track comprises a radio frequency filter.

10. An apparatus as claimed in claim 1, further comprising an electronic component positioned within the loop shape of and underlying a portion of the first conductive antenna track.

11. An apparatus as claimed in claim 1, wherein the apparatus further comprises a plurality of conductive antenna tracks coupled to the first conductive antenna track at locations in proximity to respective feed points of the plurality of feed point, and at locations between the first end and the second end of the first conductive antenna track, to form a plurality of closed loops configured to resonate in operational frequency bands.

12. The apparatus of claim 1, wherein the apparatus is comprised within a module.

13. An electronic communication device comprising:

a first conductive antenna track, extending between a first end and a second end and defining a loop shape, the first conductive antenna track comprising a first feed point adjacent to the first end and configured to couple to a radio frequency circuitry, wherein the first conductive antenna track further comprises a second feed point adjacent to the second end and configured to couple to the radio frequency circuitry, wherein the first conductive antenna track further comprises a third feed point adjacent to the second end and configured to couple to the radio frequency circuity, wherein the first conductive antenna track further comprises a ground point adjacent to the first end, and wherein the first conductive antenna track is configured to form a loop antenna between the third feed point and the ground point and to resonate in a third operational frequency band;

a second conductive antenna track coupled to the first conductive antenna track at a first location in proximity to the first feed point, and at a second location between the first end and the second end of the first conductive antenna track, to form a first closed loop configured to resonate in a first operational frequency band; and a third conductive antenna track coupled to the first conductive antenna track at a third location in proximity to the second feed point, and at a fourth location between the first end and the second end of the first conductive antenna track, to form a second closed loop configured to resonate in a second operational frequency band, wherein at least one of the first conductive antenna track comprises a curved non-planar portion between the first end and the second end or the second conductive antenna track comprises a curved non-planar portion between the first and second locations or the third conductive antenna track comprises a curved non-planar portion between the third and fourth locations, and wherein the curved non-planar portion of at least one of the first conductive antenna track, the second conductive antenna track or the third conductive antenna track is configured to form at least a part of a metallic cover of the electronic communication device.

14. An electronic communication device of claim 13 wherein at least the first conductive antenna track forms at least a part of the cover, and wherein the curved portion of at least one of the second conductive antenna track or the third conductive antenna track is configured to fit within or to form at least a part of the cover.

15. A method comprising:

providing a first conductive antenna track, extending between a first end and a second end and defining a loop shape, and comprising a first feed point located adjacent to the first end and configured to couple to a radio frequency circuitry, wherein the first conductive antenna track further comprises a second feed point located adjacent to the second end and configured to couple to the radio frequency circuitry, wherein the first conductive antenna track further comprises a third feed point adjacent to the second end and configured to couple to the radio frequency circuity, wherein the first conductive antenna track further comprises a ground point adjacent to the first end, and wherein the first conductive antenna track is configured to form a loop antenna between the third feed point and the ground point and to resonate in a third operational frequency band; and providing a second conductive antenna track coupled to the first conductive antenna track at a first location in proximity to the first feed point, and at a second location between the first end and the second end of the first conductive antenna track, to form a first closed loop configured to resonate in a first operational frequency band; and providing a third conductive antenna track coupled to the first conductive antenna track at a third location in proximity to the second feed point, and at a fourth location between the first end and the second end of the first conductive antenna track, to form a second closed loop configured to resonate in a second operational frequency band, wherein at least one of the first conductive antenna track comprises a curved non-planar portion between the first end and the second end or the second conductive antenna track comprises a curved non-planar portion between the first and second locations or the third conductive antenna track comprises a curved non-planar portion between the third and fourth locations, and wherein the curved non-planar portion of at least one of the first conductive antenna track, the second conductive antenna track or the third conductive antenna track is configured to form at least a part of a metallic cover of an electronic communication device.

16. A method as claimed in claim 15, further comprising positioning an electronic component within the loop shape of and underlying a portion of the first conductive antenna track.

17. A method as claimed in claim 15, further comprising: providing a plurality of conductive antenna tracks coupled to the first conductive antenna track at locations in proximity to respective feed points of the plurality of feed points, and at locations between the first end and the second end of the first conductive antenna track, to form a plurality of closed loops configured to resonate in operational frequency bands.

* * * * *